United States Patent [19]

Males et al.

[11] 4,334,613

[45] Jun. 15, 1982

[54] STICK PACKAGE OF SPRING CLIP FASTENERS

[75] Inventors: Robert E. Males, West Warwick; Edward A. Colechia, East Greenwich, both of R.I.

[73] Assignee: Textron Inc., Providence, R.I.

[21] Appl. No.: 130,588

[22] Filed: Mar. 14, 1980

[51] Int. Cl.[3] ..... B65D 85/24

[52] U.S. Cl. ..... 206/340

[58] Field of Search ..... 206/340; 5/259 R

[56] References Cited

U.S. PATENT DOCUMENTS 2,277,931 3/1942 Moe ..... 206/340

3,720,960 3/1973 Bond ..... 5/259 R

*Primary Examiner*—William Price

*Attorney, Agent, or Firm*—Cushman, Darby & Cushman

[57] ABSTRACT

A one-piece fastener for attaching a spring member to a frame or the like comprising a length of metal bent to provide (1) a pair of frame penetrating portions disposed generally parallel with respect to one another and having free ends configured to facilitate simultaneous entry thereof into the frame, (2) a pair of relatively short driving portions connected at one of their ends with the opposite ends of the frame penetrating portions and extending therefrom at generally right angles in directions generally toward one another, and (3) a nestable portion connected with the driving portions bent to define a hook for receiving the spring member therein. A stick package is formed of a multiplicity of fasteners. In one embodiment the nestable portions of adjacent sticks are disposed in horizontal abutting relation and the frame penetrating portions of adjacent fasteners are disposed in parallel relation. In a preferred embodiment the nestable portions are stacked vertically in addition to their nesting so that the frame penetrating portions of adjacent fasteners are in abutting relation and the stick extends at a 45° angle to the horizontal. A fastener driving device having a stepped driver movable in a drive track guidingly engages the workpiece penetrating and striking portions of each fastener during its driving movement.

18 Claims, 16 Drawing Figures

12
10
16
14
26
18
20
40
30
32
64
28
94
48
62
24
22
96
68
34
74
66
98
36
72
70
84
32
40
54
58
56
82
92
46
50
52

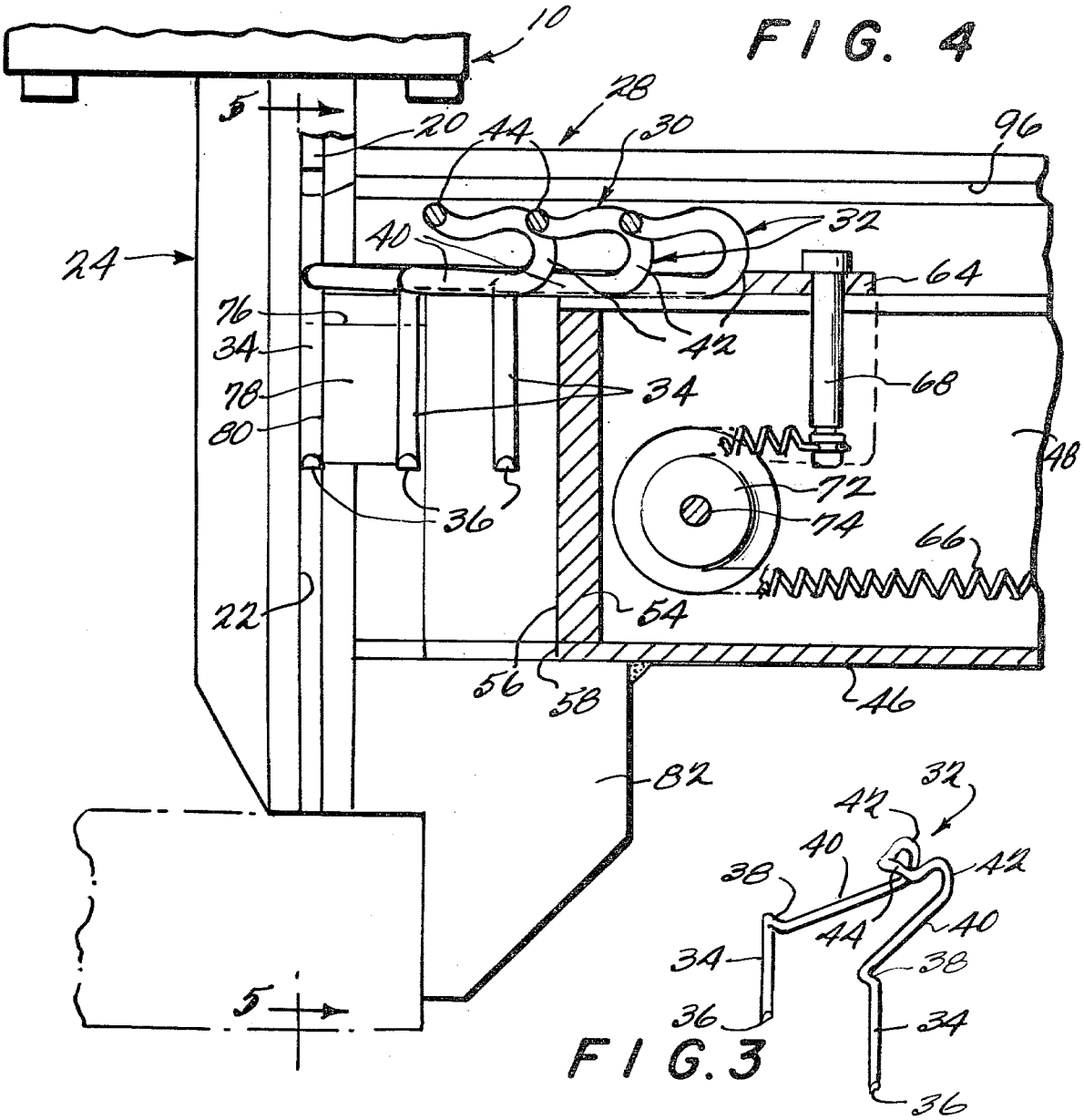
FIG. 4
FIG. 3
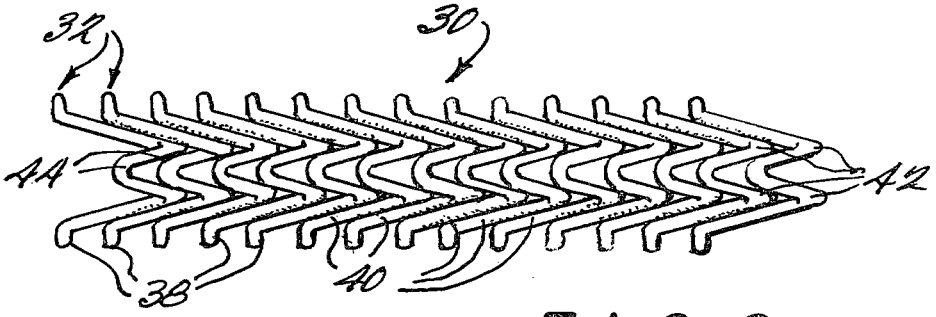
FIG. 2

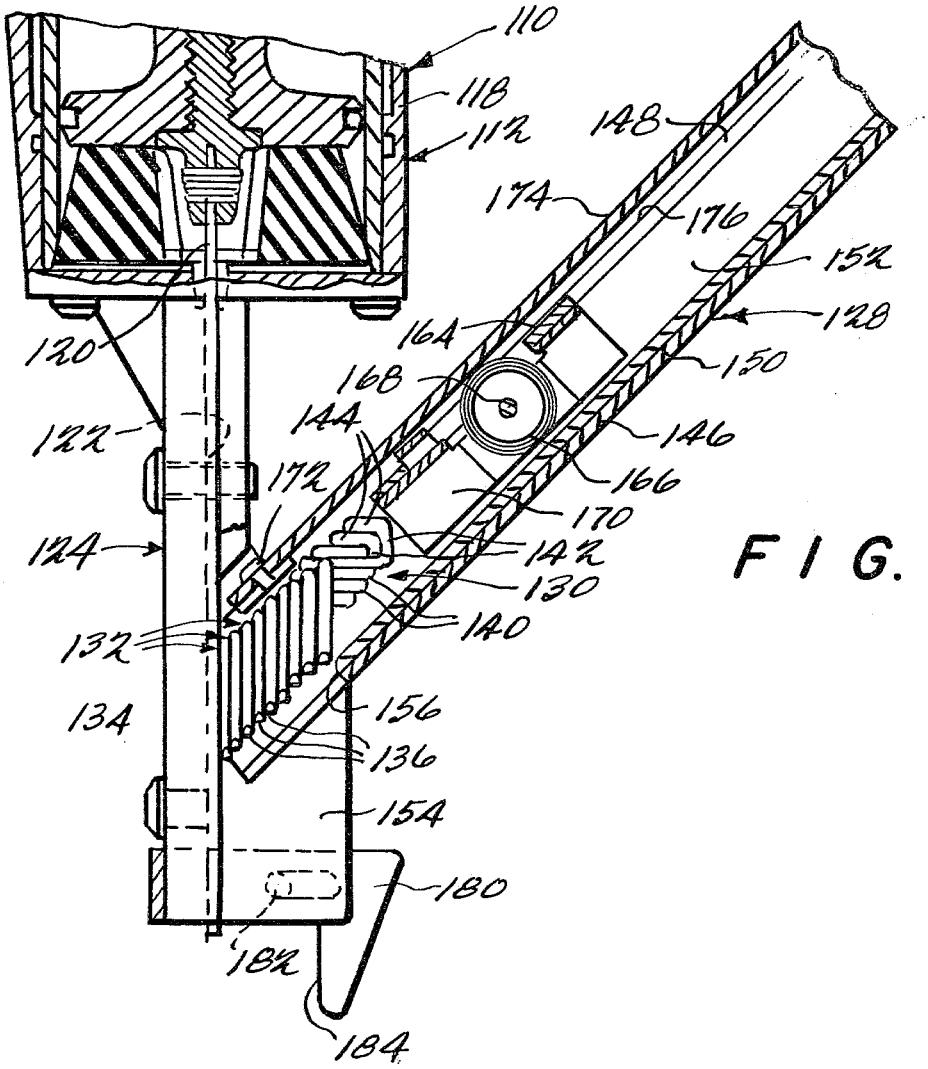
FIG. 7
FIG. 8
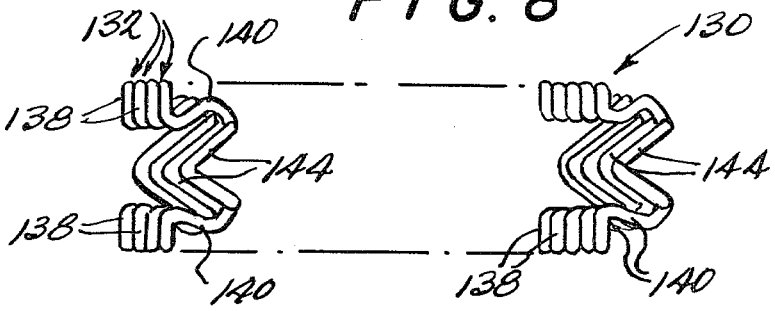

FIG. 10
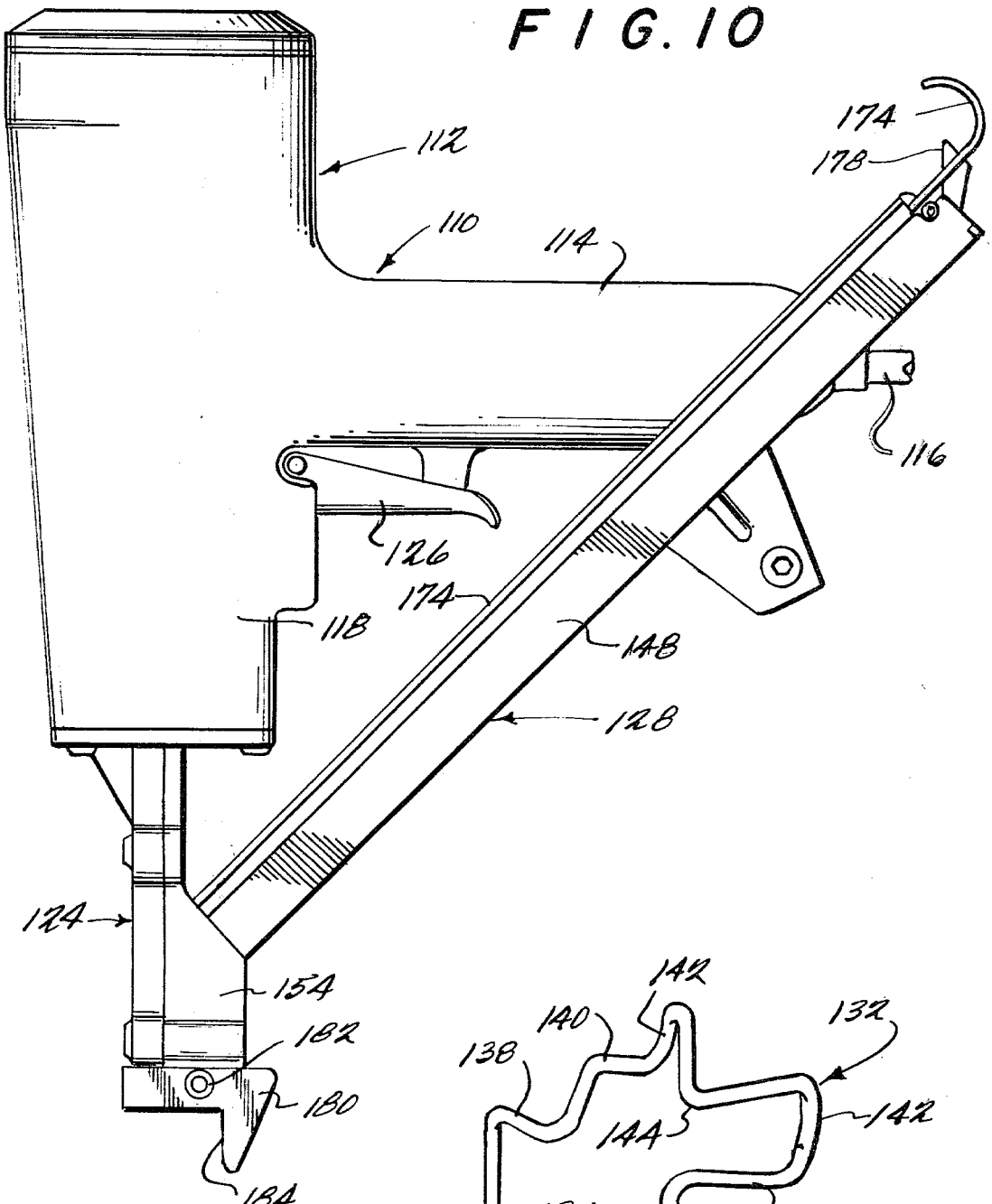
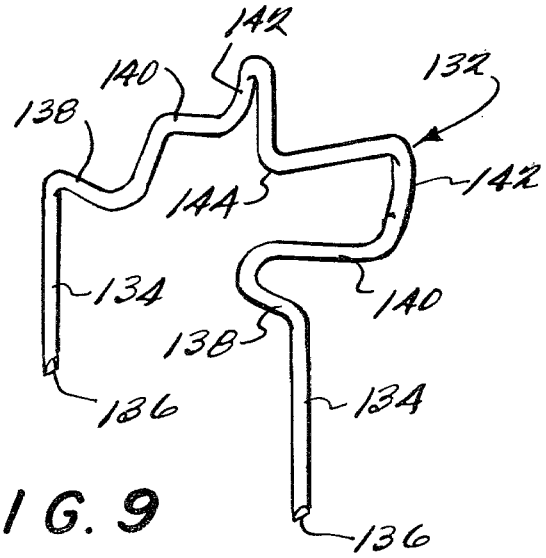
FIG. 9

FIG. 11
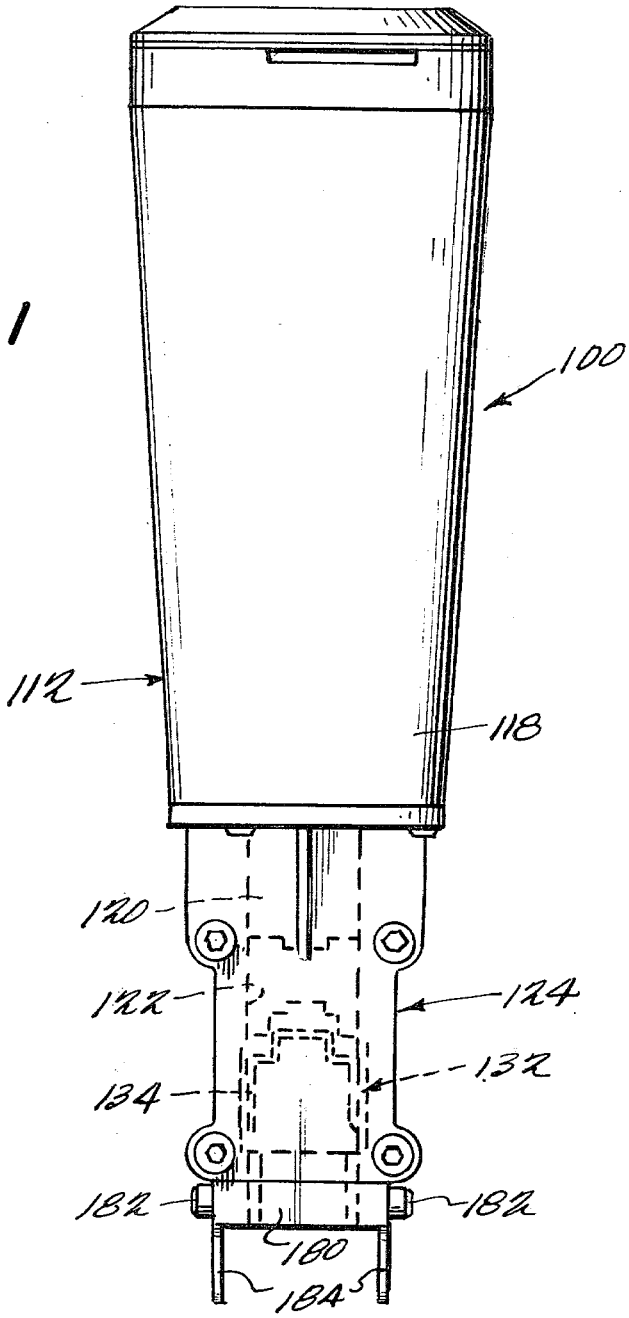
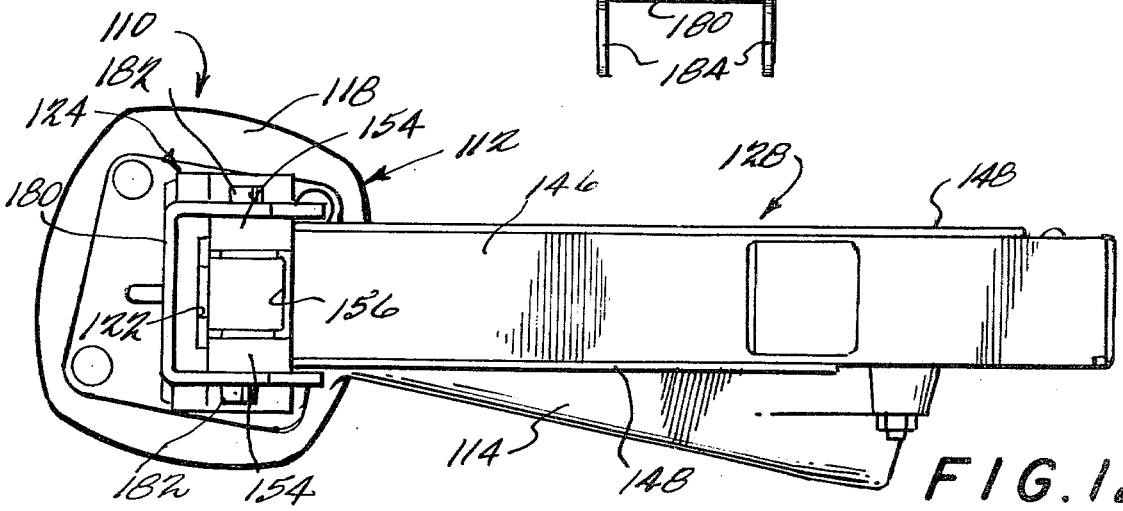
FIG. 12

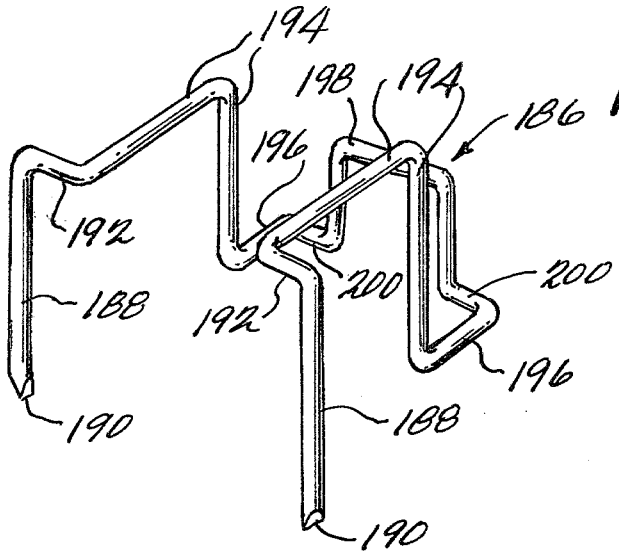
FIG. 16
FIG. 13
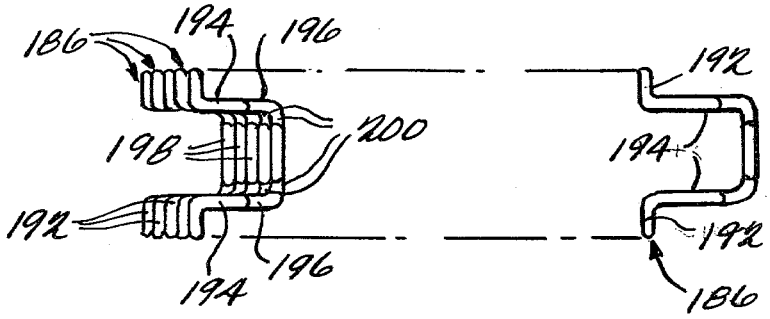
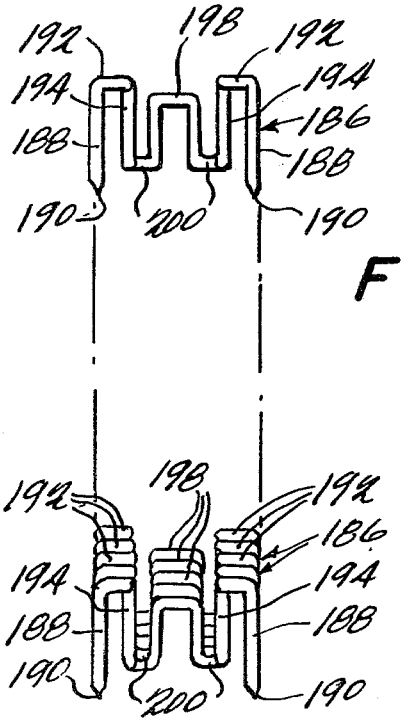
FIG. 15
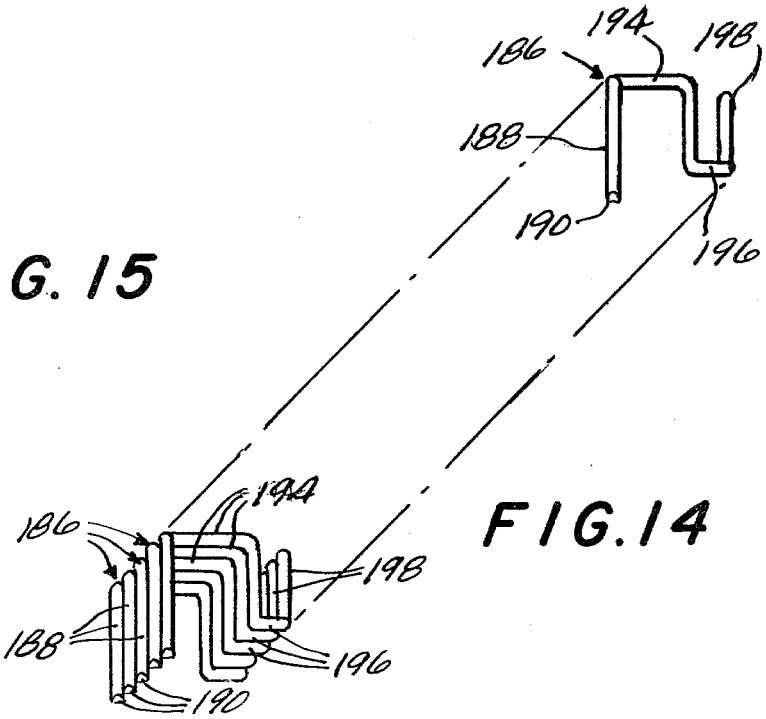
FIG. 14

STICK PACKAGE OF SPRING CLIP FASTENERS

This invention relates to fasteners and more particularly to fasteners of the clip type adapted to secure spring members to frame elements of furniture and the like and to apparatus for handling and driving such clips.

Clips of the type herein contemplated are known and have achieved some commercial acceptance. The first clips of this type utilized generally hook-shaped straps which were positioned on top of the rail and secured thereto by separate staples or nails. Examples of clips of this type are disclosed in the following U.S. Pat. Nos.: 2,886,815; 2,946,060; and 3,551,282.

Various apparatus has been provided for effecting the securement of these two-piece fastening assemblies. For example, in U.S. Pat. No. 2,886,815, the staples are in conventional straight stick formation and are driven in conventional fashion by the driver of a pneumatic fastener driving device, the hook-shaped clips are mounted in stacked relation and fed by a separate magazine assembly.

In recent years there has been a trend away from the utilizaton of two-piece fastener assemblies of this type toward one-piece assemblies such as, for example, disclosed in U.S. Pat. No. 3,720,960. Other examples of patents which disclose one-piece configurations for clips of this type are U.S. Pat. Nos. 3,773,310; 4,062,087; and 4,102,586. Certain of these patents disclose one-piece clip type fasteners formed of both strap stock as well as wire stock. Certain of the patents also disclose various arrangements for packaging a multiplicity of clips so as to render them suitable for use in automatic equipment. The arrangements disclosed include stacked arrangements similar to that provided in U.S. Pat. No. 2,886,815 as well as side-by-side arrangements in which the clips are in a string or coil. U.S. Pat. No. 4,073,423 discloses apparatus for handling a multiplicity of clips in coil formation and driving successive leading clips from the coil formation. The structure provided is of a permanent installation type and does not lend itself readily to use with portable type pneumatic fastener driving devices.

It is an object of the present invention to provide an improved fastener of the type herein contemplated capable of being packaged in a convenient nested stack formation suitable to be handled and driven by a portable pneumatic fastener driving device. In accordance with the principles of the present invention this objective is accomplished by forming the fastener from a length of metal, preferably wire, bent to form (1) a pair of frame penetrating portions disposed generally parallel with respect to one another and having free ends configured to facilitate simultaneous entry thereof into the frame, (2) a pair of relatively short driving portions connected at one of their ends with the opposite ends of the frame penetrating portions and extending therefrom at generally right angles in directions generally toward one another and (3) a nestable portion connected with the driving portions and extending transversely therefrom so as to leave the space on the side of said driving portions opposite from said workpiece penetrating portions and the space between said driving portions free of structure, the nestable portion being bent to define a hook for receiving the spring member therein. With this construction it becomes possible to package a multiplicity of such fasteners in a straight stick or row formation with the nestable portions thereof disposed in abutting nested relation and with all of the frame penetrating portions of the fasteners disposed in parallel relation with respect to one another and extending transversely to the direction of extent of the row formation. Moreover, conventional staple stick securing means may be provided for releasably retaining the fasteners in such row formation. The arrangement is such that the fastener density that can be achieved within a given stick length is quite reasonable in terms of balancing the inconvenience of weight considerations with the inconvenience of the need to reload excessively.

In one embodiment of the invention where the nested portions are nested in a plane extending generally at right angles to the extent of the penetrating portions so as to provide a horizontally extending stick capable of being driven from a magazine which extends horizontally, significant density improvement over the densities maintained in prior art clip arrangements is achieved. In preferred embodiments of the present invention wherein the nested portions are both nested and stacked so that the nested portions extend in a plane disposed at an angle of approximately 45° with respect to the direction of extent of the penetrating portions, a fastener density equal to the fastener density of conventional U-shaped staples can be achieved. Each of these 45° stick embodiments likewise requires the utilization of a magazine which extends 45° from the direction of fastener driving movement. With all of the embodiments it becomes possible to provide a magazine which is capable of holding the fastener stick and feeding the leading fastener thereof into the drive track by a simple resilient biasing in much the same fashion as conventional staple sticks are held and fed.

Thus, the present invention not only provides for the improvement of the fastener construction itself and improvements in the mounting of individual fasteners into packages, but further provides for improvements in the handling and driving of the fasteners and packages within a power operated fastener driving device.

Accordingly, it is a further object of the present invention to provide a power operated fastener driving device having an improved magazine structure for receiving and supporting a package of fasteners of the type described above and for feeding successive leading fasteners into the fastener drive track to be driven by the fastener driving element of the fastener driving device.

In accordance with the principles of the present invention this objective is obtained by providing a fastener driving device which includes the usual housing and fastener stick magazine carried thereby for receiving and supporting a fastener stick of the type described. The housing also provides the usual drive track which communicates with the magazine and fastener driving element mounted within the drive track for movement through successive reciprocating cycles, each of which includes a drive stroke and a return stroke. The fastener driving element includes a fastener engaging end having a projecting central portion which cooperates with guide surfaces in the guide track for guidingly engaging during the movement of the fastener through the drive track (1) the laterally outwardly oppositely facing surfaces of the workpiece penetrating portions of the fastener, (2) the laterally inner mutually facing surfaces of the striking portions of the fastener and (3) the leading and trailing oppositely facing surfaces of the workpieces penetrating and striking surfaces of the fastener.

With this arrangement full guiding control of the fastener during its movement through the drive track is maintained so as to minimize the likelihood of jams resulting from the inherent lack of symmetry of the fastener with respect to the drive track.

These and other objects of the present invention will become more apparent during the course of the following detailed description and appended claims.

The invention may best be understood with reference to the accompanying drawings, wherein an illustrative embodiment is shown.

In the drawings:

FIG. 1 is a side elevational view partly in section of one form of a fastener driving device embodying the principles of the present invention showing the magazine assembly thereof provided with one form of a partial spring clip fastener stick package embodying the principles of the present invention mounted therein in a position in which the leading fastener is moved partially through its drive stroke;

FIG. 2 is a top plan view of the fastener stick package shown in FIG. 1;

FIG. 3 is an isometric view of a single spring clip fastener embodying the principles of the present invention, a multiplicity of which are utilized to form the fastener stick package of FIG. 2;

FIG. 4 is an enlarged fragmentary vertical sectional view similar to FIG. 1 showing the fastener package in its normal inoperative or storage position within the magazine assembly of the fastener driving device;

FIG. 7 is a view similar to FIG. 4 showing another form of fastener package embodying the principles of the present invention disposed in its normal inoperative or storage position within another form of magazine assembly embodying the principles of the present invention of a power operated fastener driving device;

FIG. 8 is a view similar to FIG. 2 of the fastener stick package shown in FIG. 7;

FIG. 9 is a view similar to FIG. 3 of a single spring clip fastener embodying the principles of the present invention, a multiplicity of which are utilized to form the fastener stick package of FIGS. 7 and 8;

FIG. 10 is a side elevational view of the fastener driving device shown in FIG. 7;

FIG. 11 is a front elevational view of the fastener driving device shown in FIGS. 7 and 10;

FIG. 12 is a bottom plan view of the fastener driving device shown in FIGS. 7, 10 and 11;

FIG. 13 is a view similar to FIGS. 2 and 8 of another form of fastener stick package embodying the principles of the present invention;

FIG. 14 is a side elevational view of the fastener stick package shown in FIG. 13;

FIG. 15 is a front elevational view of the fastener stick package shown in FIGS. 13 and 14; and FIG. 16 is a view similar to FIGS. 3 and 9 of a single spring clip fastener embodying the principles of the present invention, a multiplicity of which are utilized to form the fastener stick package.

Figure 1:
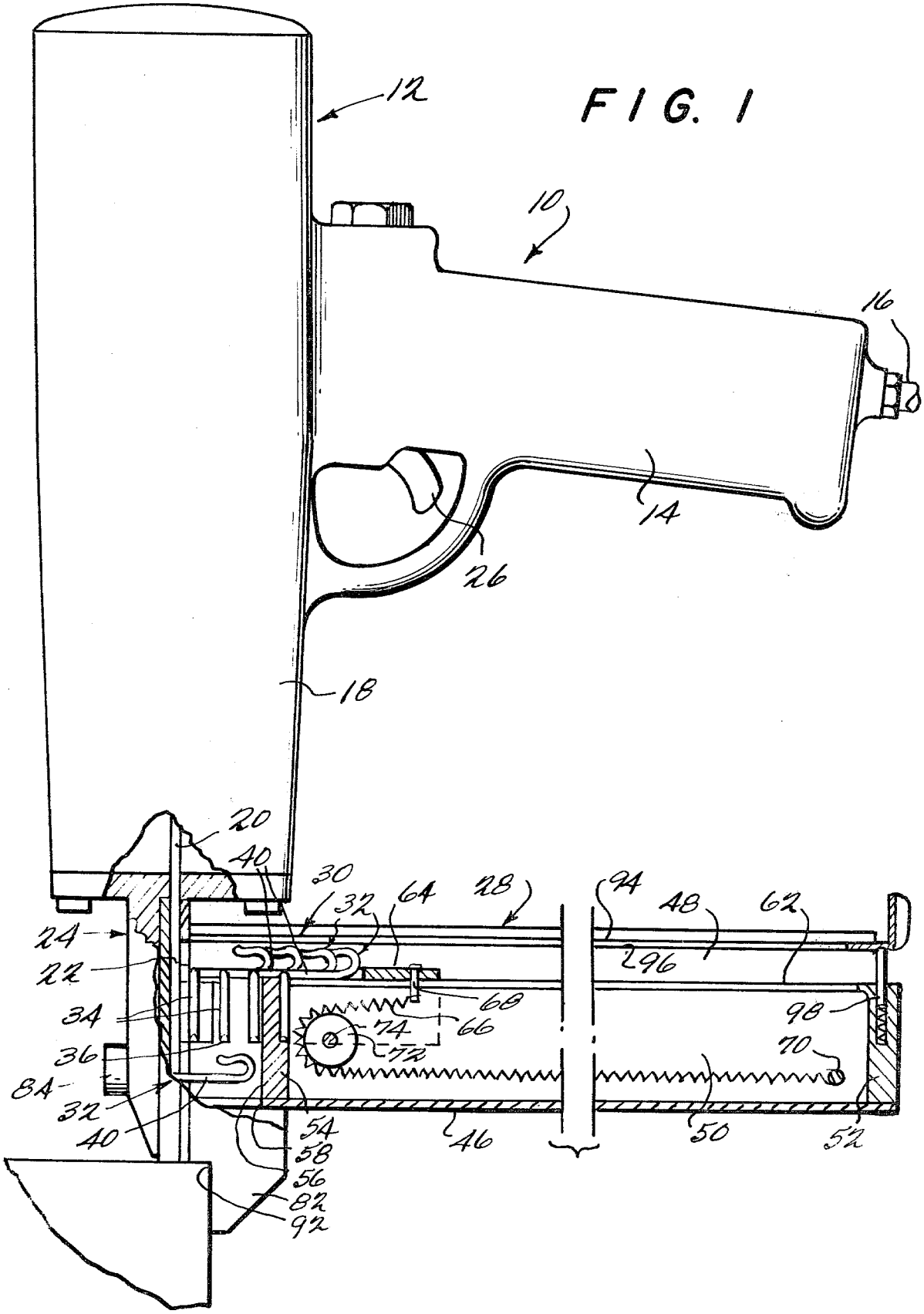

Referring now more particularly to the drawings, there is shown in FIG. 1 a portable fastener driving device, generally indicated at 10, which embodies the principles of the present invention. The fastener driving device includes the usual housing assembly, generally indicated at 12, which includes a handle portion 14 providing an exterior surface enabling the operator to grip and move the device in a portable fashion and an interior surface providing a reservoir for air under pressure received from a suitable source through an air line 16 or the like extending from the source to the end of the handle portion 14. The housing assembly 12 also includes the usual vertically extending cylinder portion 18 within which is mounted the usual driving piston (not shown) for movement through a vertically downward driving stroke and a vertically upward return stroke. The drive piston has connected therewith a fastener driving element 20 which is slidably within a drive track 22 formed in a nosepiece assembly 24 suitably fixed to the lower end of the vertically extending housing portion 18.

It will be understood that there is contained within the vertically extending housing portion 18 the usual main valve assembly (not shown) and pneumatic system for actuating the main valve assembly to move the fastener driving element 20 through a drive stroke and a return stroke. The usual digitally operated trigger 26 is shown as part of the pneumatic actuating system and it will be understood that a contact trip arrangement can likewise be utilized in conjunction with the trigger if desired. It will be understood that the pneumatic system embodied in the fastener driving device 10 may be of any well-known construction. Examples of systems which can be utilized are disclosed in U.S. Pat. Nos. 3,087,466; 3,259,292; 3,572,572; 3,708,096; and 4,039,133, the disclosures of which are hereby incorporated by reference into the present specification.

The fastener driving device 10 of the present invention also includes a magazine assembly 28 which is constructed in accordance with the principles of the present invention to receive, handle and feed a fastener stick package, generally indicated at 30, containing a multiplicity of spring clip type fasteners constructed in accordance with the principles of the present invention, each of which is generally indicated by the reference numeral 32.

Referring now more particularly to FIGS. 2 and 3, the spring clip type fastener 32 of the present invention is of one-piece construction formed of a length of metallic wire bent into a configuration enabling the fastener to serve as a securement for a spring member to a furniture frame member or the like. As best shown in FIG. 3, each fastener 32 is formed with a pair of frame penetrating portions 34, which portions are disposed generally parallel with respect to one another and have their free ends formed into a chisel configuration, as indicated at 36, for facilitating simultaneous entry thereof into the frame member. It will be understood that configurations other than the chisel configuration may be provided on the free ends of the frame penetrating portions 34 to facilitate the aforesaid simultaneous entry.

Extending from the opposite ends of the frame penetrating portions 34 at generally right angles therefrom in directions generally toward one another, is a pair of relatively short driving portions 38. The opposite ends of the short driving portions 38 have connected therewith a nestable portion which provides the hook necessary to receive the spring member after the frame penetrating portions have been driven into the frame. As shown, the nestable portion is generally of V-shaped configuration including two straight frame engaging sections 40 extending in outwardly converging relation with respect to one another from the ends of the driving portions 38 within generally the same plane. The nestable portion also includes interconnected spring holding sections 42 extending from the straight leg sections 40, the interconnection being accomplished by a generally V-shaped interconnecting section 44. It will be noted that the basic V-shaped configuration of the nestable portion, including the frame engaging sections 40, the spring holding sections 42 and the interconnecting section 44, enables a multiplicity of fasteners 32 to be mounted in a straight stick package such as the package 30 shown in FIG. 2 with the nested portions in nested horizontally abutting relation and the frame penetrating portions 34 in generally parallel relation with respect to one another.

In the arrangement shown, the angle defined between the V of the nestable portion is approximately 28°. In the nested relationship the exterior surfaces of the frame engaging sections 40 of the leading fastener 32 of the stick package 30 are disposed in abutting relation with the interior surfaces of the frame engaging sections 40 of the next adjacent fastener 32. The stick package is made up by assembling a multiplicity of the fasteners 32 in row formation in nested abutting relationship described above. Any suitable means may be provided for securing the multiplicity of individual fasteners in the row formation of the stick package. As shown, the securement is effected by providing cement on the abutting portions of the straight leg sections 40. The composition of the cement may be of conventional nature. The cement enables the leading fastener 32 when driven to be separated from the remainder of the fasteners in the stick package 30.

Figure 6:
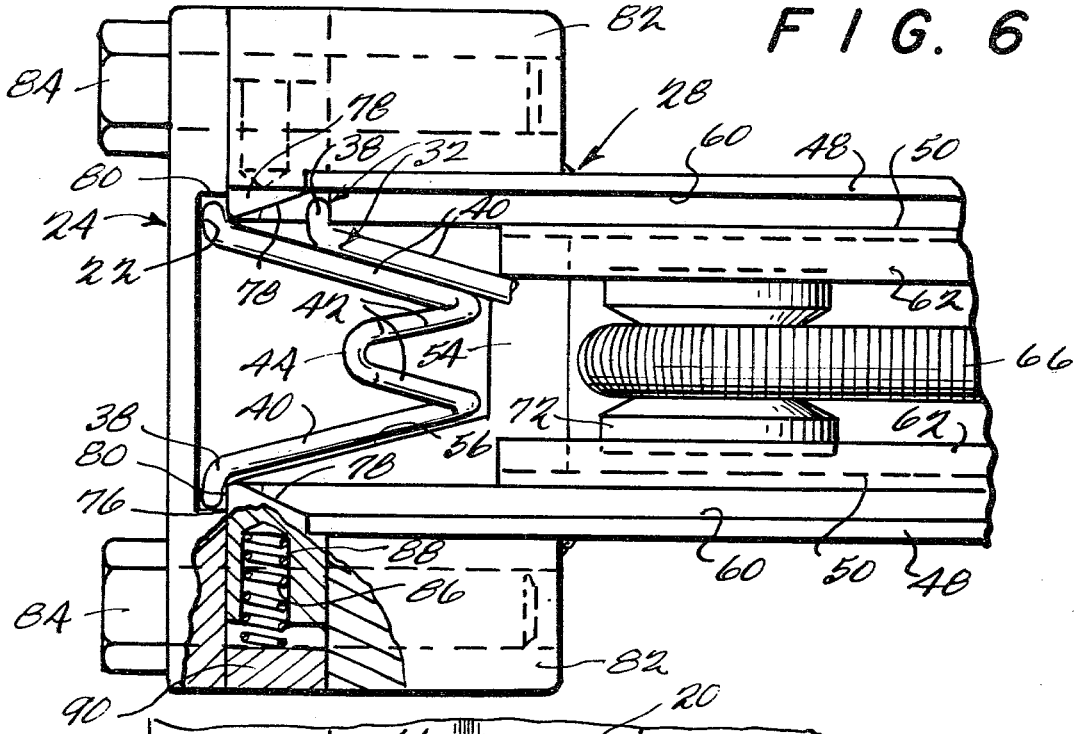
FIG. 6 is a fragmentary sectional view taken along the line 6—6 of FIG. 5.
Figure 5:
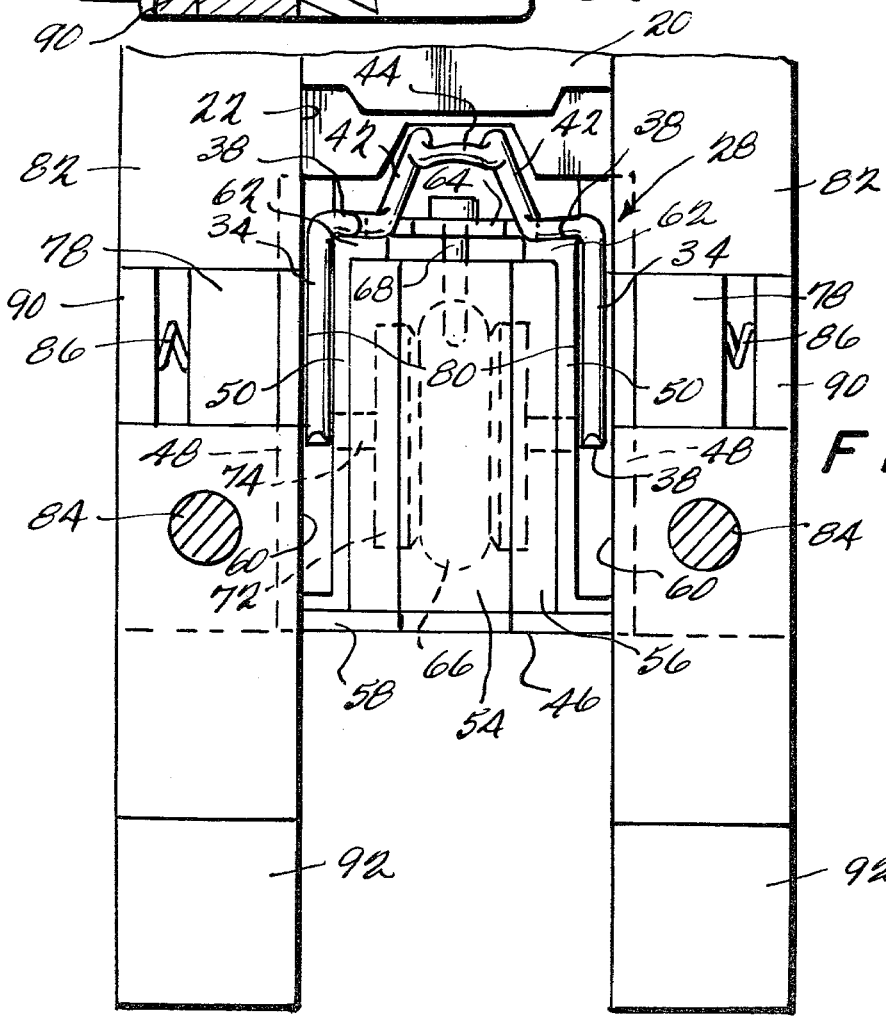
FIG. 5 is a fragmentary sectional view taken along the line 5—5 of FIG. 4.

Referring now more particularly to FIGS. 4–6, the magazine assembly 28 of the present invention shown therein includes a main elongated frame member of generally U-shaped cross-sectional configuration providing a bottom wall 46 and a pair of side walls 48 extending upwardly from the side edges thereof. Fixedly mounted, as by welding or the like, within the frame member to the bottom wall 46 thereof, is a pair of laterally spaced longitudinally extending guide rails 50. The rearward ends of the guide rails are closed by an end block 52 and the forward ends are closed by a ledge member 54 having a generally V-shaped opening 56 formed in the forward portion thereof. The bottom wall 46 of the main frame member is formed with a registering V-shaped opening 58.

The space between the exterior vertical surface of each guide rail 50 and the interior vertical surface of the adjacent side wall 48 provides guide tracks 60 within which the frame penetrating portions 34 of the fastener clips 32 are received. It will be noted that each of the guide rails 50 includes a short, inturned horizontal flange 62 at its upper end which provides horizontally extending surfaces for engagement beneath the straight sections 40 of the clip fasteners 32 and supporting the same for horizontal movement therein in a direction toward the drive track 22.

Any suitable means may be provided for resiliently biasing the stick package 30 of fastener clips 32 for movement in the direction toward the drive track. As shown, there is provided a U-shaped pusher member 64 which is mounted on the guide rails 50 for movement therealong in a manner similar to the movement of the fastener package. The forward edges of the legs of the U-shaped pusher 64 are adapted to engage the rearward surface of the frame penetrating portions 34 of the rearwardmost fastener clip 32 of the stick package 30. The U-shaped pusher member 64 is biased to move forwardly by an elongated coil spring 66 connected at one end to a central depending pin 68 on the pusher and at its other end to a pin 70 fixed between the lower rearward ends of the rails 50. The intermediate portion of the spring 66 is trained about a pulley or roller 72 rotatably mounted between the forward ends of the guide rails 50 as by a shaft 74.

In order to accurately control the position of the forwardmost fastener clip 32 within the guide track 22 there is provided a pair of latching or spring pressed detent members 76. Each of the spring pressed detent members includes a rearwardly facing inclined cam surface 78 extending into the forward end of the associated guide track 60 and a forwardly extending guide surface 80. Each spring pressed detent member 76 is mounted within an associated side block 82 fixed to the forward exterior surface of the associated side wall 48. The side blocks 82 also serve to mount the magazine structure rigidly on the fastener driving device housing as by bolts 84 extending through the nosepiece and into the side blocks. It will be noted that a coil spring 86 is associated with each spring pressed detent member 76, each coil spring having one end portion engaged within a transverse bore 88 in the associated member 76 and its other end engaged against a plug 90 mounted within the outer end of the opening provided in the associated side block 82 within which the detent member is slidably mounted.

With reference to FIGS. 1 and 4, it will be noted that each side block 82 extends downwardly below the lower end of the nosepiece and has a notch 92 extending therein which is adapted to engage a corner surface of a frame member in operation so as to properly position the drive track within the horizontal margin of the frame member.

Finally, it will be noted that the magazine assembly 28 includes a cover member 94 which is slidably mounted within slots 96 formed in the upper interior surfaces of the side walls 48. Cover member 94 is releasably retained in its operative closed position, as shown in FIG. 1, by spring detent assemblies 98.

The magazine assembly 28 is loaded by the operator moving the cover member 94 rearwardly from its normal operative closed position shown in FIG. 1 to a rearward open position providing downward access to the guide rail supporting flanges 62 and guide tracks 60. With pusher 64 moved rearwardly stressing spring 66, a stick package 30 of clips fasteners 32 is moved into proper operative position within the magazine assembly. As shown, the proper operative position is one in which the hooks of the clip fasteners open forwardly, the frame penetrating portions 34 of the fasteners are disposed within the guide tracks and the straight sections 40 are slidably supported on the upper surface of the guide rail flanges 62.

After the fastener package has been properly mounted within the magazine assembly, as aforesaid, pusher 46 is released and cover member 94 is closed. Release of pusher 46 causes the forward edges of the legs thereof to engage the rearward surfaces of the frame penetrating portions 34 of the rearwardmost clip fastener in the stick package 30. After this engagement is effected, spring 66 continues to bias the pusher forwardly together and with the forwardmost fastener clip of the package toward the drive track 22. The force of the spring 66 is sufficiently great in comparison with the force of the detent springs 86 to cause the detents to move outwardly when the frame penetrating portions 34 of the forwardmost fastener clip engage the cam surfaces 78 of the detent members. In this way, the forwardmost clip 32 is moved forwardly until the frame penetrating portions 34 are fully within the guide track 22 and the detent members 76 have moved inwardly under the action of springs 86 so that the surfaces 80 of the detent members close behind the frame penetrating portions 34.

In this position, the upper surface of the driving portions 38 are disposed below the bottom of the fastener driving element 20 in a position to be engaged thereby when the latter is moved by the pressure operated system under the control of the trigger 26. As best shown in FIG. 5, the bottom of the fastener driving element 20 is stepped so as to provide recessed end portions for engaging the upper surface of the striking portions 38 and a projecting central portion which enters between the striking portions 38 when the upper surfaces thereof are engaged. When the trigger 26 is actuated, fastener driving element 20 is moved downwardly through a drive stroke wherein the lower recesses thereof engage the striking portions 38 of the leading clip fastener 32 disposed within the drive track 22. The central projection of the fastener driving element engages the interior surfaces of the striking portions 38 and prevents inward movement thereof. The initial movement of the leading clip fastener with the driver element 20 fractures the cement or adhesive interconnecting the straight portions 40 of the leading fastener with the next adjacent fastener.

It will be noted that the V-shaped openings 56 and 58 provide for the rectilinear vertical movement of the nestable portion of the leading clip fastener downwardly from its connected position with the adjacent fastener into a position outwardly of the magazine assembly. During this movement the frame penetrating portions 34 and striking portions 38 of the leading fastener are guided within the guide track 22 for vertical rectilinear movement therethrough. Toward the end of this movement, the sharpened ends 36 initially engage the upper marginal surface of the frame member facilitating the entry of the frame penetrating portions 34 fully into the frame member. At the end of the drive stroke, the lower surfaces of the striking portions 38 and straight sections 40 engage the upper surface of the frame member, with the hook sections 42 extending beyond the adjacent vertical surface of the frame member in a position to receive the end of the spring to be mounted in accordance with conventional procedures.

Referring now more particularly to FIGS. 7–12, there is shown therein a preferred embodiment of the present invention in which the construction of each clip fastener is modified so as to maximize the density of the stick package which can be formed therewith and the fastener driving device is modified so that the magazine assembly thereof will accommodate the maximum density stick package thus formed. As best shown in FIGS. 7,10, 11 and 12, the modified portable fastener driving device is generally indicated at 110. As before, the fastener driving device includes the usual housing assembly, generally indicated at 112, which provides a handle portion 114 having an exterior surface enabling the operator to grip and move the device in a portable fashion and an interior surface providing a reservoir for air under pressure received from a suitable source through an air line 116 or the like extending from the source to the end of the handle portion 114. The housing assembly 112 also includes the usual vertically extending cylinder portion 118 within which is mounted the usual driving piston (not shown) for movement through a vertically downward driving stroke and a vertically upward return stroke. The drive piston has connected therewith a stepped fastener driving element, similar to element 20, which is slidably within a drive track 122 formed in a nosepiece assembly 124 suitably fixed to the lower end of the vertically extending housing portion 118.

It will be understood that there is contained within the vertically extending housing portion 118 the usual main valve assembly (not shown) and pneumatic system for actuating the main valve assembly to move the fastener driving element 120 through a drive stroke and a return stroke. The usual digitally operated trigger 126 is shown as part of the pneumatic actuating system and it will be understood that a contact trip arrangement can likewise be utilized in conjunction with the trigger if desired. It will be understood that the pneumatic system embodied in the fastener driving device 110 may be of any well-known construction. Examples of systems which can be utilized are disclosed in U.S. Pat. Nos. 3,087,466; 3,259,292; 3,572,572; 3,708,096; and 4,039,133, the disclosures of which are hereby incorporated by reference into the present specification.

The fastener driving device 110 of the present invention also includes a magazine assembly 128 which is constructed in accordance with the principles of the present invention to receive, handle and feed a fastener stick package, generally indicated at 130, containing a multiplicity of spring clip type fasteners constructed in accordance with the principles of the present invention, each of which is generally indicated by the reference numeral 132.

Referring now more particularly to FIGS. 8 and 9, the preferred spring clip type fastener 132 of the present invention is of one-piece construction formed of a length of metallic wire bent into a configuration enabling the fastener to serve as a securement for a spring member to a furniture frame member or the like. As best shown in FIG. 9, each fastener 132 is formed with a pair of frame penetrating portions 134, which portions are disposed generally parallel with respect to one another and have their free ends formed into a chisel configuration, as indicated at 136, for facilitating simultaneous entry thereof into the frame member. It will be understood that configurations other than the chisel configuration may be provided on the free ends of the frame penetrating portions 134 to facilitate the aforesaid simultaneous entry.

Extending from the opposite ends of the frame penetrating portion 134 at generally right angles therefrom in directions generally toward one another, is a pair of relatively short driving portions 138. The opposite ends of the short driving portions 138 have connected therewith a horizontally nestable vertically stackable portion which provides the hook necessary to receive the spring member after the frame penetrating portions have been driven into the frame. As shown, the nestable and stackable portion includes two L-shaped frame engaging sections 140 extending initially transversely from the ends of the driving portions 138 in generally outwardly diverging relation with respect to one another and finally transversely in directions toward one another. The nestable and stackable portion also includes interconnected spring holding sections 142 extending from the L-shaped sections 140, the interconnection being accomplished by a generally V-shaped interconnecting section 144. It will be noted that the configuration of the nestable and stackable portion, including the frame engaging sections 140, the spring holding sections 142 and the interconnecting section 144, enables a multiplicity of fasteners 132 to be mounted in an angular stick package such as the package 130 shown in FIG. 8 with the nestable and stackable portions in horizontally nested vertically stacked abutting relation and the frame penetrating portions 134 in generally parallel abutting relation with respect to one another.

In the nested and stacked relationship shown the upper longitudinally extending frame engaging surfaces of the sections 140 of the leading fastener 132 of the stick package 130 are disposed in abutting relation with the lower surfaces of the longitudinally extending frame engaging sections 140 of the next adjacent fastener 132. The stick package is made up by assembling a multiplicity of the fasteners 132 in row formation in the nested and stacked abutting relationship described above. Any suitable means may be provided for securing the multiplicity of individual fasteners in the row formation of the stick package. As shown, the securement is effected by providing adhesive or cement on the exterior of the abutting frame penetrating portions 134. The composition of the adhesive or cement may be of conventional nature. The cement enables the leading fastener 132 when driven to be separated from the remainder of the fasteners in the stick package 130.

Referring now more particularly to FIGS. 7 and 10–12, the magazine assembly 128 of the present invention shown therein includes a main elongated frame member of generally U-shaped cross-sectional configuration providing a bottom wall 146 and a pair of side walls 148 extending upwardly from the side edges thereof. Fixedly mounted, as by welding or the like, within the frame member to the bottom wall 146 thereof, is a U-shaped guide member having a bight portion 150 engaged to bottom wall 146 and two upstanding leg portions constituting guide rails 152. Both the frame member and guide member extend upwardly and rearwardly from the guide track 122 at an angle of 45°. The forward end of the frame member is fixed to the nosepiece 124 by a pair of side blocks 154 welded to the forward exterior of the side walls 148 and receiving bolts extending horizontally through the nosepiece. The forward ends of the bottom wall 146 and bight portion 150 adjacent the drive track have a generally U-shaped opening 156 formed in the forward portions thereof to accommodate the passage of the nestable portion of the leading fastener therethrough.

The space between the exterior vertical surfaces of the guide rails 152 and the interior vertical surfaces of the adjacent side wall 148 provides guide tracks 160 within which the frame penetrating portions 134 of the fastener clips 132 are received. The space between the guide rails 152 serves to accommodate the nestable portions of the fasteners. The horizontally extending upwardly facing edge surfaces of the guide rails 132 serve to engage beneath the driving portions 138 of the clip fasteners 132 and to support the same for horizontal movement thereon in a direction toward the drive track 122.

Any suitable means may be provided for resiliently biasing the stick package 130 of fastener clips 132 for movement in the direction toward the drive track. As shown, there is provided an inverted U-shaped pusher member 164 which is mounted on the guide rails 152 for movement therealong in a manner similar to the movement of the fastener package. The forward edges of the legs of the U-shaped pusher 164 are adapted to engage the rearward surface of the frame penetrating portions 134 of the rearwardmost fastener clip 132 of the stick package 130. The U-shaped pusher member 164 is biased to move forwardly by an elongated spirally rolled leaf spring 166. The spirally rolled end of the spring 166 is carried on a shaft 168 having its ends mounted in the depending leg portions of an inverted U-shaped mounting member 170 having its bight portion welded to the lower central surface of the pusher member.

The free end of the spirally rolled leaf spring 166 is fixedly connected as by a fastener 172 to the forward end of a slidable cover member 174. Cover member 174 has an inverted channel-shaped cross-sectional configuration with its marginal edges slidably engaged within slots 176 formed along the upper marginal portions of the side walls 148. As best shown in FIG. 1, the rearward end of the magazine frame member is formed with a releasable latch 178 which serves to maintain the cover member 174 in its operative closed position. In this regard, it will be noted that the magazine assembly extends upwardly from the nosepiece at an angle of approximately 45° and that the handle portion 114 of the housing 112 is extended angularly slightly so as to accommodate the interference occasioned by the angular inclination of the magazine assembly 128. It will also be noted that a U-shaped guide member 180 is adjustably mounted, as by adjusting bolts 182, on the lower end of the side blocks 154 in surrounding relation to the lower end of the nosepiece. The guide member provides a forwardly facing vertically extending frame engaging surface 184 spaced from the drive track 122. When the surface 184 is in engagement with the vertical surface of the frame member to which the fastener is to be attached, the position of the drive track is properly related to the horizontal surface of the frame member so that when the leading fastener is driven from the fastener driving device the hook of the fastener will be properly positioned beyond the edge of the frame member to receive the spring.

The magazine assembly 128 is loaded by releasing the latch 178 and retracting the cover member 174 rearwardly and upwardly within the guide slots 176. During this movement pusher member 164 is moved rearwardly and upwardly with the cover member. When the cover member has been fully retracted access through the top of the magazine assembly is provided. The operator then has only to slip a stick package 130 downwardly into proper position within the magazine assembly. As previously indicated, such proper position is one in which the frame penetrating portions of the clip fasteners 132 are disposed within the guide tracks 160, the nestable portions including the L-shaped frame engaging sections 140 and the hook defining sections 142 are disposed in the space between the guide rails 152, and the striking portions are engaged on the upper edges of the guide rails 152. When the fastener package 130 has been properly positioned within the magazine assembly, cover member 174 is then moved from its open access position into its closed position. During the initial portion of this movement pusher member 164 is carried forwardly and downwardly with the cover member until the leading edges thereof engage the trailing edges of the frame penetrating portions 134 of the trailing clip fastener. Further movement of the cover member 140 toward its closed position after the leading fastener has engaged within the drive track 122 will result in an extension of the spirally rolled leaf spring 166 since the mounting member 170 fixed to the pusher member 164 is prevented from further movement by engagement with the fastener package, whereas the forward end of the cover member moves forwardly and downwardly until the cover member reaches its latched closed position.

The operation of the fastener driving device to drive the leading staple from the magazine is accomplished during the drive stroke of the fastener driving element. It is important to note that the engagement of the lower recesses of the fastener driving element is upon the upper surface of two relatively short spaced-apart striking portions with the projecting central portion engaging therebetween so as to guidingly engage the mutually facing ends of the striking portions. The drive track includes surfaces for guidingly engaging the outwardly upwardly facing surfaces of the workpiece penetrating portions and the leading and trailing surfaces of both the workpiece penetrating and striking portions during the driving movement of the fastener. The rearwardly extending nestable portion of the fastener clip passes vertically downwardly through the opening 156 during the downward driving movement thereof.

It will be understood that the right angle L-shaped configuration of the frame engaging sections 140 of the clip fastener 132 is preferable, since this arrangement enables a multiplicity of such clip fasteners to be easily collated and mounted in a stick package 130. Other arrangements are possible in which the stick angle would be less than 45°, such as for example, where the angle between the legs of the L-shaped section is greater than 90° with the greater angle being taken up by virtue of the longitudinal extents converging outwardly from the striking portions.

Referring now more particularly to FIGS. 13 to 16, there is shown therein a modified form of a spring clip fastener 186 which is generally of the type disclosed in U.S. Pat. No. 3,710,960 (FIG. 4). As before, spring clip fastener 186 is of one-piece construction formed of a length of metallic wire bent into a configuration enabling the fastener to serve as a securement for a spring member to a furniture frame member or the like. As best shown in FIG. 16, each fastener 186 is formed with a pair of frame penetrating portions 188, which portions are disposed generally parallel with respect to one another and have their free ends formed into a chisel configuration, as indicated at 190, for facilitating simultaneous entry thereof into the frame member. It will be understood that configurations other than the chisel configuration may be provided on the free ends of the frame penetrating portions 188 to facilitate the aforesaid simultaneous entry.

Extending from the opposite ends of the frame penetrating portions 188 at generally right angles therefrom in directions generally toward one another, is a pair of relatively short driving portions 192. The opposite ends of the short driving portions 192 have connected therewith a nestable and stackable portion which provides the hook necessary to receive the spring member after the frame penetrating portions have been driven into the frame. As shown, the nestable and stackable portion includes two L-shaped frame engaging sections 194 extending initially from the ends of the driving portions 138 in generally parallel relation with respect to one another within generally the same plane and finally transversely in generally parallel relation with respect to one another and to the workpiece penetrating portions 188. The nestable and stackable portion also includes interconnected spring holding sections 196 extending from the L-shaped sections 194, the interconnection being accomplished by a generally U-shaped central interconnecting section 198 and two short interconnecting sections 200 aligned with respect to one another in parallel relation with the striking portions 192. It will be noted that the configuration of the nestable and stackable portion, including the frame engaging sections, the spring holding sections and the interconnecting sections 198 and 200, enables a multiplicity of fasteners 186 to be mounted in an angular stick package such as the package 202 shown in FIGS. 13–15 with the nestable and stackable portions in nested and stacked abutting relation and the frame penetrating portions 188 in generally parallel abutting relation with respect to one another.

In the nested and stacked relationship shown the upwardly and rearwardly facing angular frame engaging surfaces of the L-shaped sections 194 of the leading fastener 186 of the stick package 202 are disposed in abutting relation with the downwardly and forwardly facing angular surfaces of the frame engaging sections 194 of the next adjacent fastener 186. The stick package is made up by assembling a multiplicity of the fasteners 186 in row formation in the nested and stacked abutting relationship described above. Any suitable means may be provided for securing the multiplicity of individual fasteners in the row formation of the stick package. As shown, the securement is effected by providing adhesive or cement on the exterior of the abutting frame penetrating portions 188. The composition of the adhesive or cement may be of conventional nature. The cement enables the leading fastener 186, when driven to be separated from the remainder of the fasteners in the stick package 202. The fastener package 202 is mounted in the fastener driving device and operated therein in the same manner as the fastener package 130.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A fastener package comprising a multiplicity of one-piece fasteners for attaching a spring member to a frame or the like, each of said fasteners including a bent length of metal providing (1) a pair of frame penetrating portions disposed generally parallel with respect to one another and having free ends configured to facilitate simultaneous entry thereof into the frame, (2) a pair of relatively short driving portions connected at one of their ends with the opposite ends of said frame penetrating portions and extending therefrom at generally right angles in directions generally toward one another, and (3) a nestable portion connected with said driving portions bent to define a hook for receiving the spring member therein, said multiplicity of fasteners being disposed in abutting row formation with the nestable portions thereof disposed in nested relation, all of the frame penetrating portions of said fasteners being parallel with one another and extending transversely to the direction of extent of the row formation, and means for securing said multiplicity of fasteners in said row formation permitting release of a leading fastener in the row formation in response to a driving movement in the direction of extent of said frame penetrating portions thereof imparted to the driving portions thereof.

2. A fastener package as defined in claim 1 wherein said nestable portion of each fastener includes a pair of frame engaging sections extending transversely from the opposite ends of the driving portions so as to leave the space on the side of said driving portions opposite from said workpiece penetrating portions and the space between said driving portions free of structure and interconnected spring holding sections extending from said frame engaging sections.

3. A fastener package as defined in claim 2 wherein each of said pair of frame engaging sections of each fastener is straight, the straight sections of each fastener extending from the associated driving portions in outwardly converging relation with respect to one another, the converging straight sections of each fastener defining an angle of approximately 28° therebetween, the converging straight sections of adjacent fasteners in the row formation being disposed in nested abutting relation.

4. A fastener package as defined in claim 3 wherein said securing means comprises adhesive on said abutting sections.

5. A fastener package as defined in claim 2 wherein each of said pair of frame engaging sections of each fastener is generally L-shaped, the L-shaped sections of adjacent fasteners being disposed in stacked abutting relation and the frame penetrating portions of adjacent fasteners being disposed in abutting relation.

6. A fastener package as defined in claim 5 wherein the L-shaped sections of each fastener have frame engaging surfaces disposed in a single plane.

7. A fastener package as defined in claim 5 wherein the L-shaped sections of each fastener have frame engaging surfaces disposed in two intersecting planes generally perpendicular to one another.

8. A fastener package as defined in claim 5 wherein said securing means comprises adhesive on said abutting frame penetrating portions.

9. A fastener package as defined in claim 1, 2, 3, 4, 5, 6, 7 or 8, wherein said length of metal of each fastener is a wire.

10. A fastener package as defined in claim 7 wherein said wire of each fastener is of generally circular cross-sectional configuration.

11. A fastener package comprising a multiplicity of one-piece fasteners, each of said fasteners including a bent length of metal providing (1) a pair of workpiece penetrating portions disposed generally parallel with respect to one another and having free ends configured to facilitate simultaneous entry thereof into a workpiece;

(2) a pair of relatively short driving portions connected at one of their ends with the opposite ends of said workpiece penetrating portions and extending therefrom at generally right angles in directions generally toward one another, and (3) a nestable and stackable portion connected with said driving portions extending transversely therefrom so as to leave the space on the side of said driving portions opposite from said workpiece penetrating portions free of structure, said multiplicity of fasteners being disposed in abutting row formation with the nestable and stackable portions thereof disposed in nested and stacked relation, all of the workpiece penetrating portions of said fasteners being parallel with one another and extending transversely to the direction of extent of the row formation with the workpiece penetrating portions of each fastener abutting the associated workpiece penetrating portions of the adjacent fastener of the row formation, and means for securing said multiplicity of fasteners in said row formation permitting release of a leading fastener in the row formation in response to a driving movement in the direction of extent of said workpiece penetrating portions thereof imparted to the driving portions thereof.

12. A fastener package as defined in claim 11 wherein said nestable and stackable portion of each fastener includes a pair of frame engaging sections extending from the opposite ends of the driving portions and interconnected spring holding sections extending from said frame engaging sections.

13. A fastener package as defined in claim 12 wherein each of said pair of frame engaging sections of each fastener is L-shaped, the L-shaped sections of adjacent fasteners being in stacked abutting relation.

14. A fastener package as defined in claim 13 wherein the L-shaped sections of each fastener have frame engaging surfaces disposed in a single plane.

15. A fastener package as defined in claim 13 wherein the L-shaped sections of each fastener have frame engaging surfaces disposed in two intersecting planes generally perpendicular to one another.

16. A fastener package as defined in claim 13 wherein said securing means comprises adhesive on said abutting frame penetrating portions.

17. A fastener package as defined in claim 11, 12, 13, 14, 15 or 16 wherein said length of metal of each fastener is a wire.

18. A fastener package as defined in claim 17 wherein said wire of each fastener is of generally circular cross-sectional configuration.

* * * * *